United States Patent [19]

Ueda

[11] Patent Number: 4,582,971

[45] Date of Patent: Apr. 15, 1986

[54] AUTOMATIC HIGH-FREQUENCY HEATING APPARATUS

[75] Inventor: Shigeki Ueda, Yamatokoriyama, Japan

[73] Assignee: Matshushita Electric Industrial Co., Ltd., Osaka, Japan

[21] Appl. No.: 698,393

[22] Filed: Feb. 5, 1985

[30] Foreign Application Priority Data

Feb. 7, 1984 [JP] Japan ..... 59-21019
Feb. 14, 1984 [JP] Japan ..... 59-25402
Feb. 14, 1984 [JP] Japan ..... 59-25403

[51] Int. Cl.[4] ..... H05B 6/68

[52] U.S. Cl. ..... 219/10.55 B; 219/10.55 R; 99/325

[58] Field of Search ..... 219/10.55 B, 10.55 M, 219/10.55 R, 10.55 E, 492; 99/325, 451, DIG. 14; 426/243, 523

[56] References Cited

U.S. PATENT DOCUMENTS 4,115,678 9/1978 Tachikawa et al. ..... 219/10.55 B
4,242,554 12/1980 Hurko et al. ..... 219/10.55 B
4,332,992 6/1982 Larsen et al. ..... 219/10.55 B X
4,379,964 4/1983 Kanazawa et al. ..... 219/10.55 B X
4,481,394 11/1984 Tanabe ..... 219/10.55 B
4,499,357 2/1985 Kojima ..... 219/10.55 B

FOREIGN PATENT DOCUMENTS 59-4610 1/1984 Japan .

*Primary Examiner*—Philip H. Leung
*Attorney, Agent, or Firm*—Spencer & Frank

[57] ABSTRACT

An automatic high-frequency heating apparatus of a composite type which comprises a heat source such as an electric heater or a gas burner for heating food by heat radiation or convection and a microwave source such as a magnetron for effecting microwave oscillation, and wherein both heating sources are energized and deenergized alternately, a sensor detects water vapor and/or a gas emitted from the heated food, and control means operates to automatically terminate the heating operation of the heating apparatus upon lapse of at least the time required before the sensor detects the emission of at least a predetermined amount of water vapor and/or a gas within a predetermined time period.

4 Claims, 8 Drawing Figures

AUTOMATIC HIGH-FREQUENCY HEATING APPARATUS

BACKGROUND OF THE INVENTION

The present invention relates to a high-frequency heating apparatus of the composite type comprising a heater, and more particularly to an automatic high-frequency heating apparatus in which automatic operation is effected by the use of a humidity sensor or a gas sensor to provide alternate heating with an electric heater and a microwave heater.

The alternate heating of an object to be heated from the outside and inside thereof at the same time is generally called "pair heating", "combination heating" or "mixed heating" and finds wide application in what is called a microwave oven range, namely, a high-frequency heating apparatus of the composite type comprising an electric heater and a magnetron heater. The alternate heating is capable of cooking a part of oven heating food within a short time without any preheating process. This alternate heating permits speedy cooking of roast beef, roast pork, pound cake, etc., so that it has been highly valued as a method specifically utilizable by the microwave oven range.

The alternate heating process, however, has a disadvantage in that the quantity of the object to be heated is limited. In oven heating, food is baked in an enclosed oven chamber over a predetermined time period with the temperature in the oven chamber kept at a predetermined level, and generally the length of time necessary for completing the oven heating is almost not affected by variations in the quantity of food. In the case of microwave heating, on the other hand, energy is absorbed directly into the food, and therefore the heating time changes with the quantity of food. Despite the fact that alternate heating has the advantages of making preheating peculiar to oven heating unnecessary and shortening the completion time length, it is accompanied by the disadvantage that the heating time depends on the food quantity. Thus, in conventional alternate heating which is controlled by time and temperature, restrictions on the food quantity have been unavoidable.

The present invention is intended to obviate the above-mentioned disadvantage of the prior art, and the object thereof is to provide a high-frequency heating apparatus capable of automatic cooking by alternate heating without restrictions on the food quantity.

SUMMARY OF THE INVENTION

In order to attain the above-mentioned purpose, the present inventiin provides a high-frequency heating apparatus comprising a sensor for detecting water vapor or a gas emitted from an object to be heating, wherein the end of heating of the object is controlled on the basis of the time elasped before a predetermined amount of water vapor or a gas is detected within a predetermined time period, while, alternate heating is effected with an oven heater and a microwave heater, whereby it is made possible to eliminate the temperature dependency of the sensor and to detect the completion of alternate heating.

BRIEF DESCRIPTION OF THE DRAWINGS

The present invention will be apparent from the following detailed description taken in conjunction with the accompanying drawings, in which.

DESCRIPTION OF A PREFERRED EMBODIMENT

An embodiment of the present invention will be described below with reference to the accompanying drawings.

Figure 1:
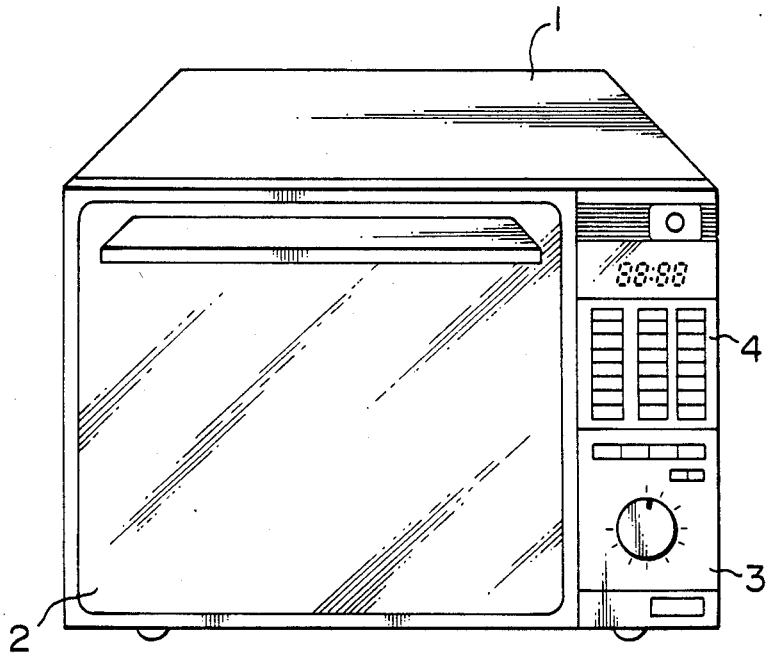
FIG. 1 is a perspective view of the body of a high-frequency heating apparatus of an embodiment of the present invention.

FIG. 1 is a perspective view of a high-frequency heating apparatus of the present invention. A door 2 adapted to be opened and closed freely and an operating panel 3 are arranged on the front side of a body 1. Auto keys 4 are arranged on the operating panel 3, and by selecting the auto keys 4 a user is able to effect automatic cooking of a desired menu of food.

Figure 2:
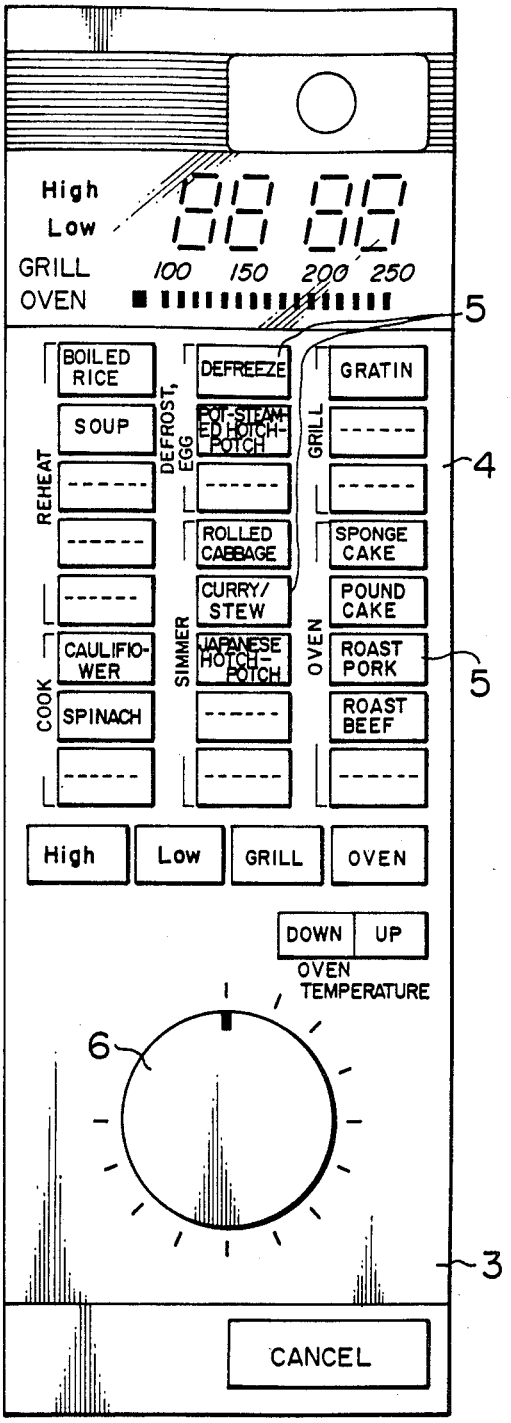
FIG. 2 is a detail drawing showing the operating panel of the same embodiment shown in FIG. 1.

FIG. 2 illustrates essential parts of the operating panel 3 in detail. The auto keys 4 included various menu items as shown in FIG. 2. The menu of food to be cooked by the alternate heating includes oven-heated food such as pound cake and roast beef, boiled food such as rolled cabbage and curry/stew, and pot-steamed hotchpotch (Japanese food using eggs), which are to be cooked by selecting alternate heating keys 5.

Numeral 6 designates a timer knob which is used for setting a heating time when manual heating operation is selected.

Figure 3:
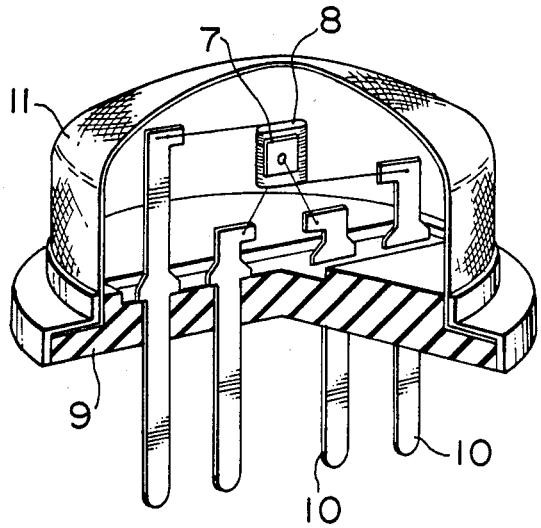
FIG. 3 is a partially sectional perspective view of essential parts of an absolute humidity sensor as an example of the sensor used in the present invention.

FIG. 3 is a partially sectional view of essential parts of an absolute humidity sensor which shows the "Neo-Humiceram" of the Matsushita Electric Industrial Company as an example of the sensor.

The sensor element 7 is made of $MgO—ZrO_2$ ceramics, on the surface of which a pair of electrodes made of the $RuO_2$ family of materials are formed and connected with lead wires. An indirect heater 8 is arranged around the sensor element 7, so that the sensor element 7 is indirectly heated to about 550° C. thereby causing gas molecules to be chemically absorbed into the surface of the $MgO—ZrO_2$ ceramics.

A base 9 supports terminals 10. A mesh cover 11 protects the sensor element 7 and prevents the heater 8 from being influenced by a draft.

Figure 4:
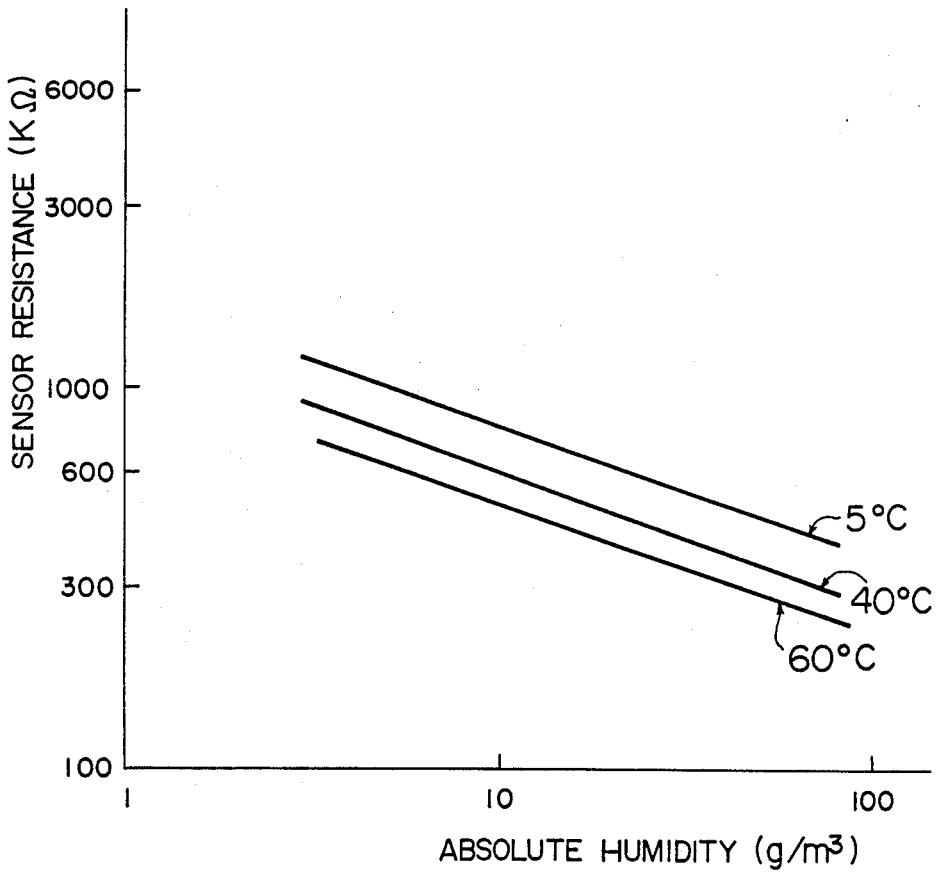
FIG. 4 is a characteristic diagram showing the temperature dependency of the sensor.

FIG. 4 shows the humidity sensitivity characteristics of the sensor. It will be seen from FIG. 4 that the sensor resistance changes with absolute humidity and is also affected by the ambient temperature. Thus, it is seen therefrom that it is unavoidable that such a sensor of the indirect heating type is temperature dependent. As a result, with a gradual increase in the gas temperature during a food heating operation, the sensor resistance changes to show an apparent increase in the absolute humidity.

Figure 5:
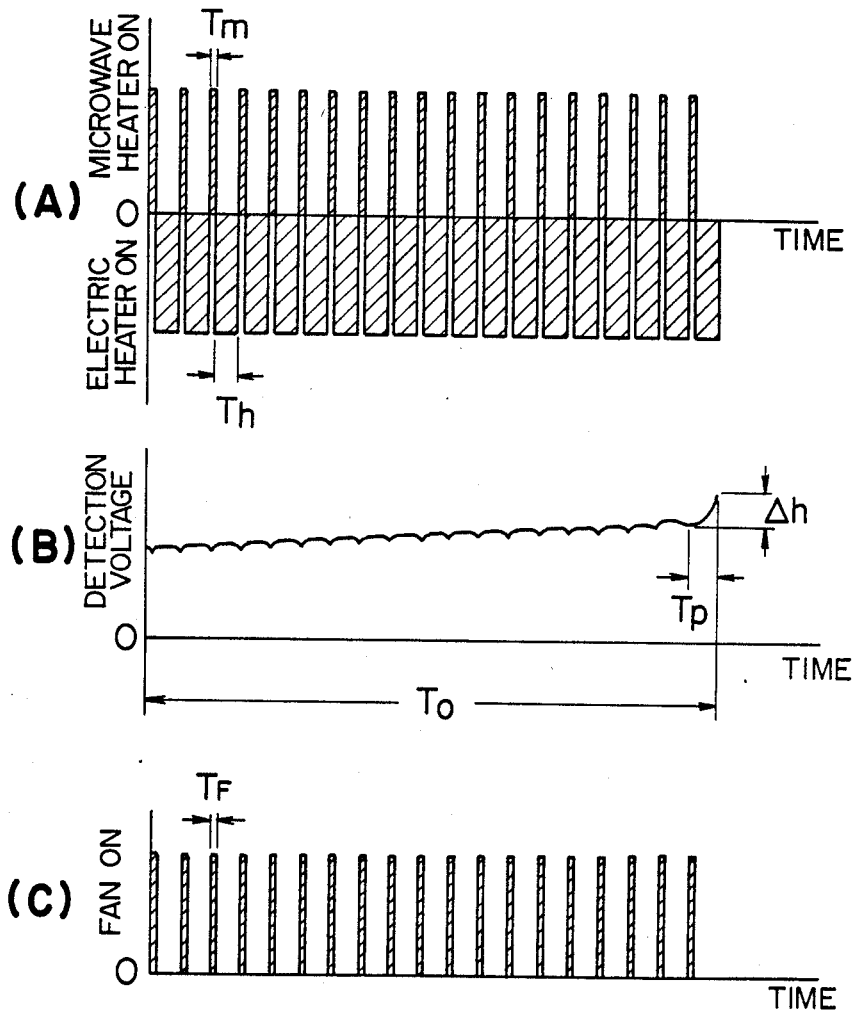
FIGS. 5(A), (B) and (C) show a heating pattern for an embodiment of the present invention.

FIG. 5 shows a pattern of alternate heating performed by an embodiment of the present invention. As shown in FIG. 5(A), power is supplied to the microwave heater and the electric heater alternately for time lengths of Tm and Th, respectively. Thus, the period of the power supplied is repeated with the time length tm plus Th. While the electric heater is on, the temperature in the heating chamber is regulated at a predetermined temperature. As an example of the heating operation, with the time Tm set to 10 seconds, time Th to 40 seconds and the temperature regulated at 150° C., it was possible to effect successful cooking of pot-steamed hotchpotch.

In this heating operation, the detection voltage of the humidity sensor was as shown in FIG. 5(B). A gas sensor manufactured by Figaro Company operates in a similar manner. In this gas sensor, however, since the sensor element is heated by an indirect heater, the detection voltage of the sensor is affected by the temperature around the sensor, as described hereinabove with reference to FIG. 4. Thus, the sensor detection voltage rises slowly with a temperature rise in the heating chamber until the temperature increases sharply at the time of emission of water vapor. Thus, in order to assure the detection of the water vapor emission time point, a time point, where a rise in the detection voltage of the sensor within a predetermined time period Tp exceeds a threshold value $\Delta h$, is detected to stop automatically the heating operation. Here, since the sensor detection voltage changes with a rise in the temperature in the heating chamber so slowly, the sensor detection voltage change within the time period Tp does not exceed the threshold value $\Delta h$, and therefore it is possible to eliminate the effect of a temperature rise in the heating chamber. If the predetermined time period Tp is determined to be Tm+Th or an integral multiple thereof; that is $Tp=n(Tm+Th)$, where n is an integer equal to at least 1, and the starting point thereof is determined to synchronize with the energization of the microwave heater, it is possible to avoid an undesirable state where the counting-up of Tp takes place while the sensor detection voltage is rising at the time of water vapor emission and the detection of the water vapor emission time point is delayed until the next detection cycle.

Further, if a fan for the ventilation of the heating chamber is driven in synchronism with the energization of the microwave heater (FIG. 5(C)), it is possible to prevent the heat in the heating chamber from escaping from the heating chamber. Further, the sensitivity of the humidity sensor can be raised if the water vapor emitted from food during the heating thereof is stored in the heating chamber and then ventilated by the ventilation fan at the same time with the next energization of the microwave heater. This effect is further enhanced if an energization time $T_F$ of the fan is made shorter than the microwave heating time Tm. That is, keeping the fan turned off during a portion of the time that the microwave heater is operating efficiently prevents heat produced in the heating chamber from escaping while maintaining the temperature rise of the microwave heater within tolerable limits.

Figure 6:
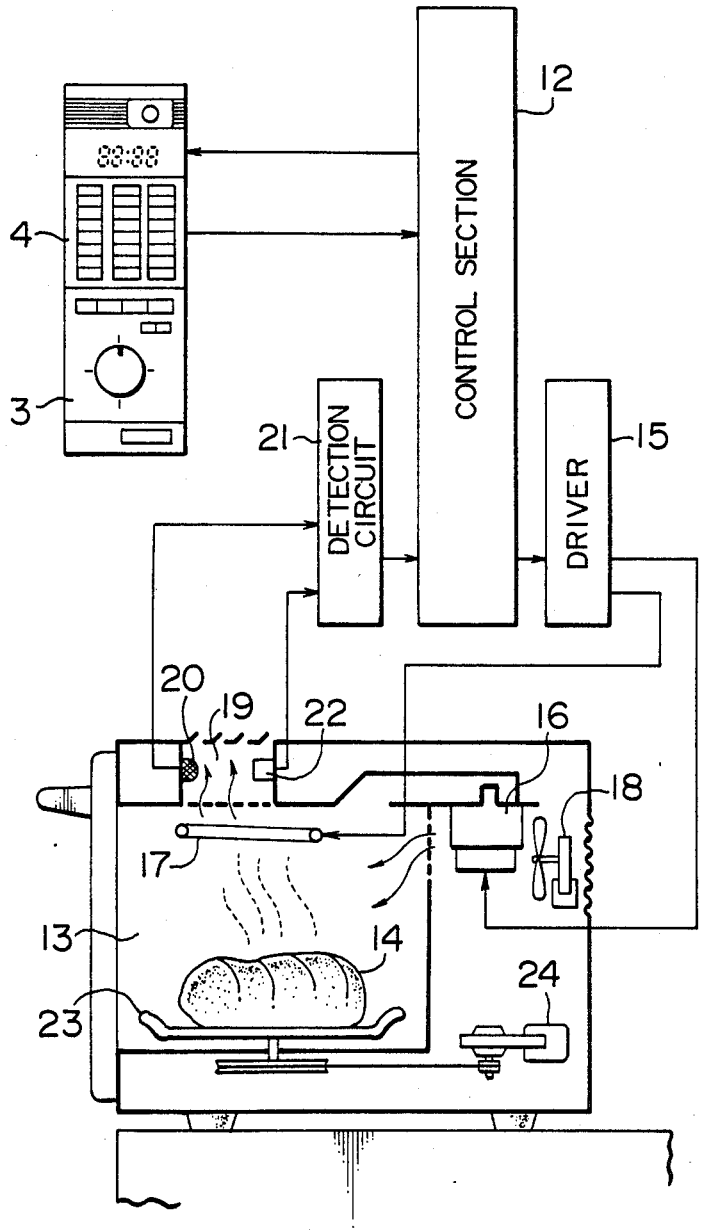
FIG. 6 is a block diagram showing the structure of the same embodiment of the present invention.

The construction of the high-frequency heating apparatus of this invention will be explained hereunder. In FIG. 6, an automatic cooking command inputted through the auto keys 4 on the operating panel 3 is decoded in a control section 12. The control section 12 causes a driver 15 to start alternate energization of a magnetron of a high frequency source 16 and an electric heater 17 thereby to start heating of an object 14 to be heated placed in the heating chamber 13. A fan 18 cools the magnetron in operation and at the same time ventilates the heating chamber 13 and exhausts the ventilated air outwardly from the body of the apparatus through an exhaust guide 19. A humidity sensor 20 is disposed in the exhaust guide 19, and it supplies data regarding the quantity of water vapor or a gas emitted from the object 14 to the control section 12 through a detection circuit 21. A thermistor 22 is also disposed in the exhaust guide 19 to control the temperature of air in the heating chamber 13 heated by the electric heater 17. A pan 23 is rotated by a motor 24 to prevent uneven baking.

Figure 7:
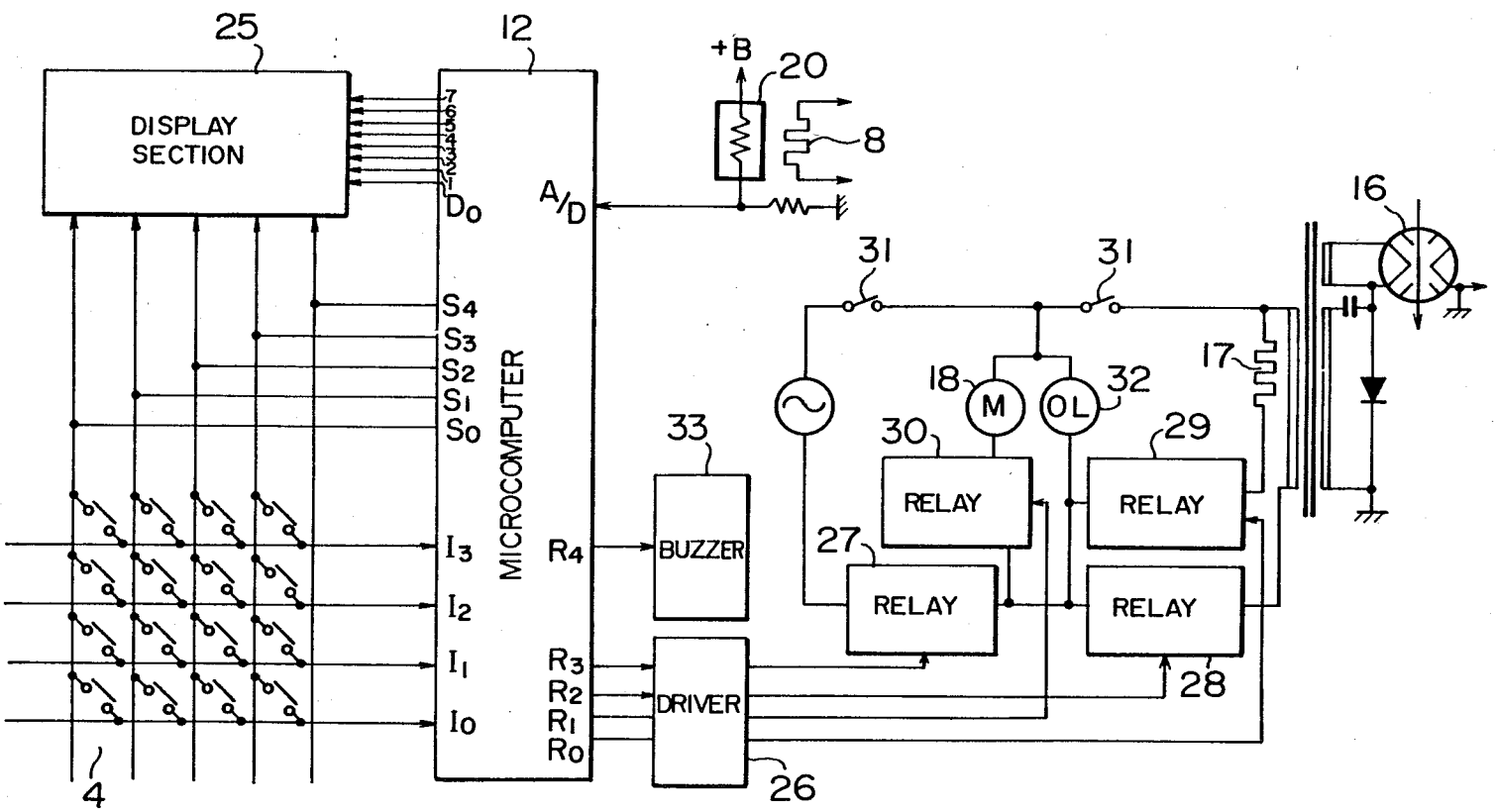
FIG. 7 is a diagram showing a concrete circuit construction of the same embodiment of the present invention.

FIG. 7 shows a concrete construction of the control circuit of the heating apparatus of this invention. The control section 12 includes a microcomputer (hereinafter referred to simply as "computer"). The command inputted through the auto keys 4 and supplied to the input terminals $I_0$ to $I_3$ of the computer 12 is decoded in the computer 12 and a predetermined indication is given on a display section 25. The display section 25 employs a dynamic lighting system so as to reduce the number of signal lines. Lighting data are supplied to the display section 25 from data output terminals $D_0$ to $D_7$ of the computer 12, and digit control signals are supplied to the display section 25 from digit output terminals $S_0$ to $S_4$ of the computer 12.

Further, the digit control signals are also used as a sweep signal for the key matrix at the same time.

On the other hand, the output of the humidity sensor 20 is applied to an A/D conversion input terminal A/D of the computer 12 to measure a change in the resistance value with a change in the humidity. Numeral 8 designates an indirect heater connected to a constant voltage source.

Upon the start of heating, the computer 12 produces relay control output signals from its relay control output terminals $R_0$ to $R_3$ and the relay control output signals are supplied to a driver 26. A relay 27 controls total power supply to the heating apparatus. A relay 28 controls an output of the microwave heater by intermittent energization thereof. A relay 29 controls power supply to the electric heater 17. A relay 30 controls the rotational operation of the fan 18. Numeral 16 designates a magnetron constituting a microwave energy source. With the above-mentioned arrangement of relays, it is possible to effect heating control as indicated by the heating pattern shown in FIG. 5.

Numeral 31 designates door switches responsive to opening and closing operations of the door 2. Numeral 32 designates a lamp in the heating chamber. Numeral 33 designates a buzzer controlled by an output signal from the output terminal $R_4$ of the computer 12. The buzzer 33 is used to inform a user of the completion of the heating operation, etc.

Figure 8:
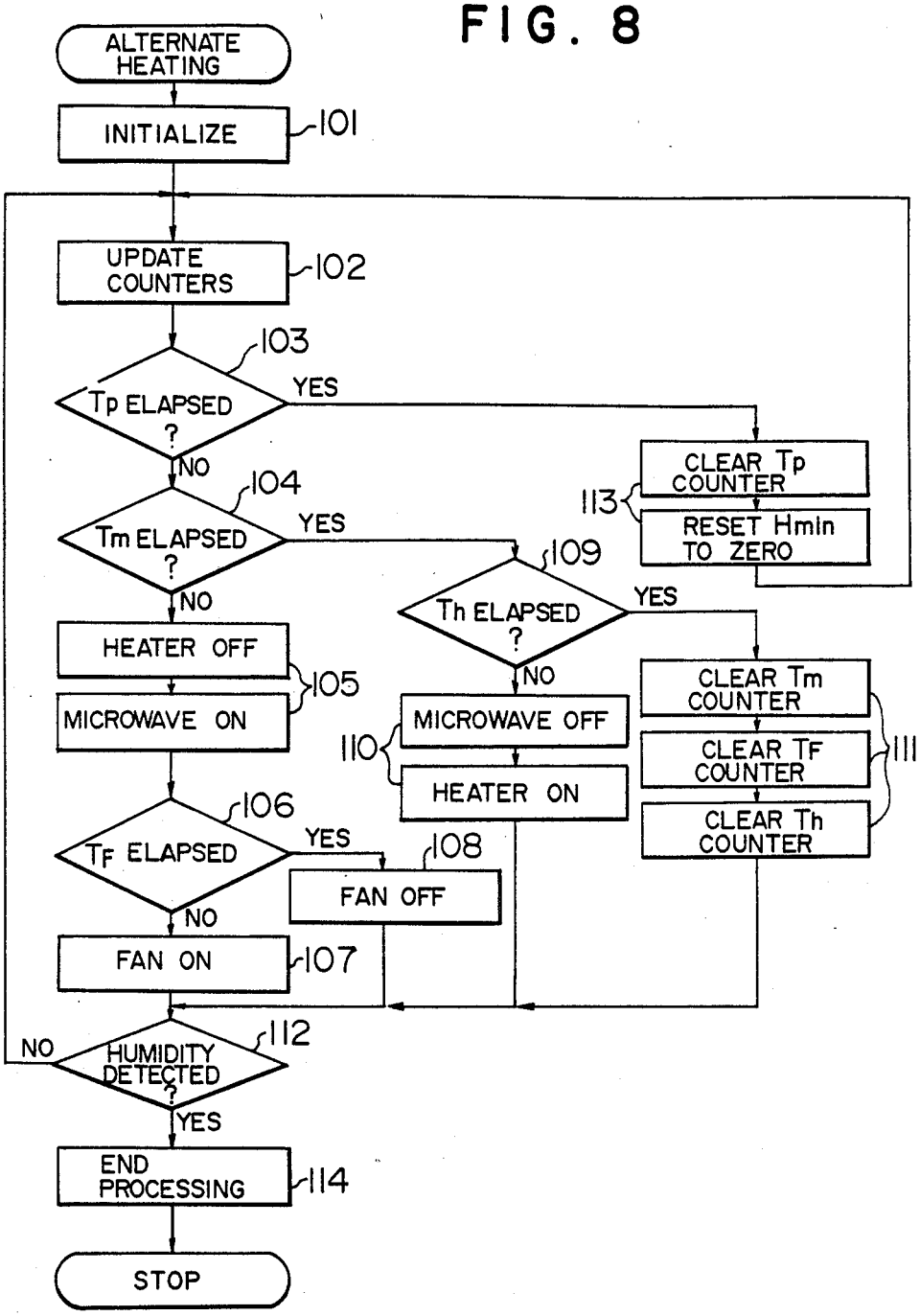
FIG. 8 is a flowchart showing a control program for the same embodiment of the present invention.

FIG. 8 is a flowchart of a control program repesenting a method of controlling the alternate heating operation. As a first step, counters and registers are cleared or set to a predetermined value (step 101). The respective counters for the predetermined detection time period Tp, the microwave heating time Tm, the electric heater heating time Th, and the fan energization time $T_F$ are updated (step 102).

The step 103 decides whether the time Tp for one detection cycle has elapsed or not, and the next step 104 decides whether the time Tm has elapsed or not. If the time Tm has not yet elapsed and if the electric heater is off, then microwave energy is supplied to the heating chamber in the manner shown in FIG. 5 (step 105). Then, a step 106 decides whether the time $T_F$ has elapsed or not, and, as a result, the fan 18 is either turned on (step 107) or turned off (step 108).

If the time Tm has elapsed already, on the other hand, the step 109 decides whether time Th has elapsed or not. If the time Th has not yet elapsed and if the microwave heater is off, then the electric heater is energized (step 110). If the time Th has already elapsed, the Tm, $T_F$ and Th counters are cleared (step 111).

Thus, according to the values of Tm, $T_F$ and Th, the heaters and the fan are controlled in the manner mentioned above. Before the time Tp has elapsed, whether the humidity change Δh has exceeded a predetermined threshold level is decided (step 112). After the lapse of the time Tp, the Tp counter is cleared, and a minimum humidity value Hmin is reset (step 113). In step 113, the deletion of the temperature dependency of the humidity sensor is attained by the resetting of the minimum humidity value Hmin. Since any humidity change of Δh and more has not occurred during the predetermined time Tp, it is decided that there has not been any considerable change in the humidity, and a next cycle follows to decide whether a humidity change of at least Δh occurs during the next detection cycle.

When it is decided that the humidity change has reached the predetermined level, a process for stopping the heating operation is effected (step 114). Namely, the completion of the heating operation is announced by the buzzer 33 and the power supply to the electric heater and the microwave heater is turned off.

Though, in the above-described embodiment of this invention, the completion of cooking is decided at the time point of arriving at a predetermined condition of the humidity detection, the apparatus may be constructed in a different manner such that some kinds of food are further heated for an additional time length $KT_0$ obtained by multiplying the time $T_0$ required before the detection (FIG. 5) by a constant K. Such a cooking time $T_0+KT_0$ is suitable for food such as curry, stew, etc. which is greater in volume and is apt to be subjected to uneven heating. On the other hand, the method of completing the cooking process at the time point of the predetermined humidity detection is suitable for food which is sensitive to the degree of heating. For example, by using the humidity detection method, it is possible to attain quite even and satisfactory heating of food such as Japanese pot-steamed hotchpotch.

It will be understood from the foregoing description that the present invention has the following advantages:

(1) Even when a humidity sensor or a gas sensor of the indirect heating type, in which the detection voltage is affected by the ambient temperature, is used, it is possible to eliminate its temperature dependency and thereby assure accurate detection of the time point where emission of water vapor or a gas occurs during alternate heating.

(2) Since the completion time point of the alternate heating is detected by a sensor, easily available alternate heating without any limitation on the quantity of food can be realized.

(3) Even when the threshold value for humidity detection is set low, any misoperation due to temperature variations can be avoided. Therefore, it is possible to effect optimum heating of food, which is sensitive to the degree of heating and requires the detection of a small amount of water vapour emission, such as pot-steamed hotchpotch, pudding, meringue, etc.

The apparatus according to the present invention is applicable not only to a microwave oven range comprising heat sources such as an electric heater, a gas burner etc. but also to air-conditioning equipment, a chemical plant, etc. which require that humidity detection by effected under temperature varying conditions.

I claim:

1. A high-frequency heating apparatus comprising a heating chamber for accommodating an object to be heated, microwave generating means coupled to said heating chamber, a heat source for raising the temperature in said heating chamber, sensor means having a temperature dependent characteristics for detecting at least one of water vapor and gas emitted from said object, and control means for controlling energization and deenergization of said microwave generating means and said heat source, wherein said control means alternately energized and deenergizes said microwave generating means and said heat source to effect operations of radiating with microwaves and heating of said object, said control means determining the time required from the start of said radiating and heating operations until said sensor means detects the emission of at least a predetermined amount of at least one of said water vapor and gas from said object within a predetermined time period and terminating said radiating and heating operations upon lapse of at least said required time.

2. A high-frequency heating apparatus according to claim 1, wherein said sensor means is an absolute humidity sensor capable of detecting absolute humidity.

3. A high-frequency heating apparatus according to claim 1, further comprising a fan for ventilating said heating chamber, said fan being turned on for at least part of the time said microwave generating means is energized, said fan being further kept on for a time period shorter than the period of time during which said microwave generating means is energized.

4. A high-frequency heating apparatus according to claim 1, wherein a detection period $T_p$ of said sensor means is selected to be equal to an integral multiple of the sum of an energization time Tm of said microwave generating means and an energization time Th of said heat source, as represented by $Tp=n(Tm+Th)$, where n is an integer equal to at least 1.

* * * * *